United States Patent [19]

Newbrough

[11] 4,083,660

[45] Apr. 11, 1978

[54] GAS DRIVE OIL WELL PUMPING SYSTEM HAVING MIXING MEANS FOR THE GAS/OIL MIXTURE

[76] Inventor: Joseph S. Newbrough, 1869 Wedgemere, El Cajon, Calif. 92020

[21] Appl. No.: 782,848

[22] Filed: Mar. 30, 1977

Related U.S. Application Data

[63] Continuation of Ser. No. 601,263, Aug. 4, 1975, abandoned.

[51] Int. Cl.[2] ..... F04F 1/20; F04F 5/24

[52] U.S. Cl. ..... 417/108; 417/172; 166/106; 166/177

[58] Field of Search ..... 417/108, 430, 172; 210/445, 448; 55/485; 166/105.1, 105.3, 106, 177

[56] References Cited

U.S. PATENT DOCUMENTS

| | | | |
|---|---|---|---|
| 1,615,761 | 1/1927 | Hendricks | 417/108 |
| 1,854,282 | 4/1932 | Thornhill | 210/448 |
| 1,908,933 | 5/1933 | Tinello | 210/445 |
| 2,068,858 | 1/1937 | Jones | 210/445 |
| 2,439,468 | 4/1948 | Hopkins | 166/105.1 |
| 2,612,111 | 9/1952 | Humason | 417/172 |
| 2,674,202 | 4/1954 | Kelley et al. | 417/172 |
| 3,551,074 | 12/1970 | Stout | 417/172 |
| 3,718,407 | 2/1973 | Newbrough | 417/108 |

*Primary Examiner*—Carlton R. Croyle
*Assistant Examiner*—Thomas I. Ross
*Attorney, Agent, or Firm*—Brown & Martin

[57] ABSTRACT

The system incorporates conical screens spaced along the producing tubing as mixing means to reduce the separation of gas and oil and enhances the lifting power of the gas. Supplemental lift devices are provided for non-flowing wells. The lift devices incorporate check valves in conjunction with the mixing means to lift the oil in stages. Motive power is provided by one or more jet pumps positioned in the producing zone and at vertically spaced points along the producing tubing.

8 Claims, 8 Drawing Figures

GAS DRIVE OIL WELL PUMPING SYSTEM HAVING MIXING MEANS FOR THE GAS/OIL MIXTURE

This is a continuation of application, Ser. No. 601,263, filed Aug. 4, 1975, now abandoned.

BACKGROUND OF THE INVENTION

Many oil wells are produced utilizing gas pressure. The use of a gas drive for producing oil is particularly prevalent in deep wells, because deep wells cannot be practically produced by the sucker rod pump method. Thus, where water flood techniques are ot applicable, gas pressure is the only practical means to force the oil up the producing tubing. In some cases, the naturally occuring gas pressure within the strata is sufficient to force a slug of oil through the producing tubing. However, as the propelling gas and oil move upward in the producing tubing, they encounter pressure and temperature changes that permit the gas and oil to separate into two distinct phases. In such wells, the slug of oil is followed by a relatively long duration gas discharge. The discharge of gas without oil is an inefficient use of the natural gas pressure and dissipates the gas pressure before the formation has been fully produced. If the well is sufficiently deep, it may be necessary to cap the well even though large quantities of oil remain in the formation. In some caes, it is possible to add large quantities of gas to the natural formation by pumping the gas down a second well that penetrates the formation. However, the gas must be injected at high pressure. The weight of gas in the drill string adds to the original pressure to produce a total pressure that may exceed the strength capabilities of the injecting well. Further, other factors, such as porosity of the strata, may make such injection in a second well impractical.

Therefore, it is desirable to have a gas drive oil well pumping system that enhances the lifting power of gas by minimizing the separation of the gas and oil into distinct phases. Such an oil well pumping system is particularly desirable where it provides a means of injecting gas into the producing well casing at relatively low pressures to directly lift the gas in stages.

SUMMARY OF THE INVENTION

A system for injecting pressurized gas directly into the producing well is described in applicant's previously patented invention, U.S. Pat. No. 3,718,407, issued Feb. 17, 1973, the specification of which patent is hereby incorporated by reference.

An exemplary embodiment of the invention represents an improvement of prior art devices and applicant's own patent. The efficiency of the gas/oil intermixing devices is improved and the total available lifting power of the jet pumps is enhanced.

For reasons of clarity, the produced liquid is uniformly referred to as oil. However, it should be understood that the invention is equally applicable to the pumping and lifting of other liquids as well and that the term "oil" as utilized in the specification and claims should be read as including such other liquids.

An exemplary embodiment of the invention incorporates an improved gas/oil mixing means. The mixing means coomprises a plurality of interfitted conical screens positioned within the producing tubing. In flowing wells, the conical screens are positioned between producing tubing sections at the joint coupling. Each conical screen terminates in a peripheral rim that is sized to fit between the ends of the producing tubing sections and to be grasped and held in position by the action of the joint coupling. The screens produce a turbulent mixing action of the gas and oil passing through the screens, retards the separation of the gas and oil, and thereby increases the quantity of oil provided per unit volume of gas. The pressure drop across each set of screens is nominal. Accordingly, the screens do not substantially retard the progress of gas and oil but rather merely maintains the gas and oil in a thoroughly intermixed condition. The screens are positioned along the producing tubing at intervals as required. The conical interfitted design produces a relatively larger screen area within the tubing cross section than could otherwise be obtained and thereby further reduces the pressure loss for each unit.

Conical screens may also be incorporated with supplemental lift devices utilized in wells that are not naturally flowing. In this instance, a central pipe within the producing tubing terminates with a fitting that accommodates a relatively smaller conical screen unit. The individual interfitting conical screens have corresponding interfitting annular collars that are threadably received over the externally threaded central pipe. The gas that has separated from the oil in a particular section of producing tubing is forced to intermix with oil passing up the central pipe and is thereby remixed in a turbulent flowing action, renewing its lifting capability. The supplemental lift device also incorporates an improved check valve with a manifold gallery of flow passages. The flow passages in the manifold are each smaller in diameter than the diameter of the check valve ball. However, the cross sectional area of the manifold passages in sum is equal to, or greater than, the cross sectional area of the central pipe, thereby reducing the pressure loss occasioned by the use of the check valve.

At least one jet pump is utilized to lift oil in non-flowing wells. A producing zone jet pump is always utilized and is positioned just above the producing zone and above a side wall packer. Gas pressure forced into the annulus between the production casing and producing tubing will enter the jet pump. The jet pump aspirates and draws in oil and provides an initial mixing of gas with the oil entering the production casing and producing tubing from the producing zone. Additional jet pumps may be incorporated at spaced intervals by incorporating them in joint couplings between the producing tubing sections. The use of a plurality of jet pumps reduces the lift head required of any individual jet pump and thereby reduces the maximum gas pressure requirement. The lower pressures possible avoid structural damage and minimize the complexity of the compresser required to inject the gas.

The invention contemplates the use of a new and improved jet pump wherein the compressed gas is delivered by a manifold from the production casing and into the interior of the producing tubing. A centrally located jet nozzle injects the gas at high velocity directly up the axis of the producing tubing. Oil is intermixed with the gas in the high velocity low pressure section of a venturi. The venturi terminates in a diffuser section to maximize the efficiency of the rapidly moving gas and oil stream. In the improved design, the minimum cross sectional area of flow of oil is increased over previous designs except in the throat of the venturi wherein maximum motive is available. Accordingly, the design is capable of higher flow rates and improved mixing capability.

It is therefore an object of the invention to provide a new and improved gas drive oil well pumping system.

It is another object of the invention to provide a new and improved gas drive system with enhanced capability for maintaining the gas and oil in a intermixed condition.

It is another object of the invention to provide a new and improved gas drive system that reduces the pressure loss through the mixing devices, check valves and jet pumps.

It is another object of the invention to provide a new and improved gas drive system that may be operated at a reduced gas drive pressure.

It is another object of the invention to provide a new and improved gas drive system that is useful in producing oil from deep wells.

Other objects and many attendant advantages of the invention will become more apparent upon a reading of the following detailed description, together with the drawings in which like reference numerals refer to like parts throughout and in which.

DETAILED DESCRIPTION OF THE DRAWINGS

Figures 4, 5, 6:
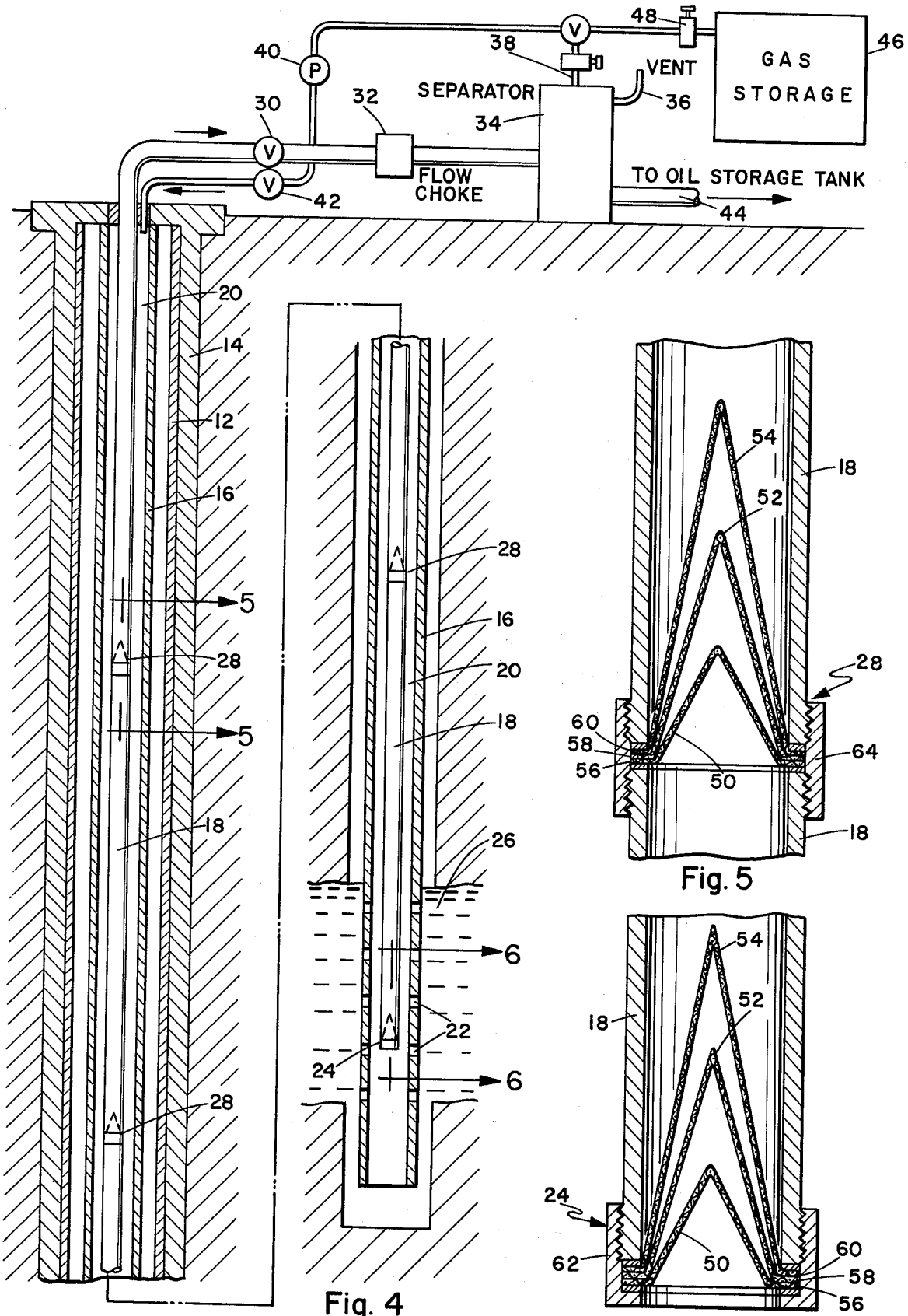
FIG. 4 is an axial sectional view of a pipe string with alternative lift inducing means.
FIG. 5 is an enlarged sectional view taken on line 5—5 of FIG. 4.
FIG. 6 is an enlarged sectional view taken on line 6—6 of FIG. 4.

Referring particularly to FIG. 4, there is illustrated the use of the improved gas/oil mixing means of the invetion in a direct lift producing well. The well hole is protected by surface casing 12 surrounded by a layer of surface concrete casing 14. The production casing 16 extends throughout the entire depth of the well and to the producing zone 26. Producing tubing 18 is located within the producing casing 16. The tubing 18 and casing 16 form an annulus 20 surrounding the producing tubing 18. The production casing admits oil into the annulus 20 through a plurality of openings 22. The oil rises in the annulus 20 and producing tubing 18 to a level determined by the natural pressure of gas in the formation.

An initial conical screen device 24 is located at the terminal portion of the producing tubing. A plurality of supplemental conical screen units 28 are located along the production string. The oil is forced up the producing tubing and through each of the conical screen units 24 and 28 to the surface.

It will be understood that the mixing devices may be utilized in a well that has sufficient natural pressure to force the oil to the surface and may also be used in a well in which the natural pressure must be supplemented. FIG. 4 illustrates a pressurizing system for adding to the natural pressure be separating and recycling the produced gas. Such a system may also be utilized with the supplemental lift system illustrated in FIG. 1 to be described hereinafter.

At the surface, the oil and gas pass through a valve 30 and flow choke 32 and are delivered to a separator 34. In separator 34, the gas is separated from the oil and delivered via lines 36 or 38. Gas delivered on line 36 is vented or delivered to production storage as is appropriate. The gas delivered via line 38 is recirculated into the annulus 20. Oil separated by the separator 34 is delivered on line 44 into storage. The recirculating gas is supplemented as necessary from a gas storage facility 46 that may add gas into the recirculating system by the operation of valves 48 and pump 40.

A system as described, either in a naturally flowing well or in a well in which the natural pressure is supplemented from the surface, will normally flow intermittedly. That is, a slug of oil will be delivered to the surface followed by a relatively long period wherein nothing but gas is delivered from the well. This condition results in an excessive use of gas and depletion of the natural gas pressure. However, with the instant invention the conical screens 24 and 28 intermix the gas and oil and retard the separation of the gas and oil into distinct phases.

The design of the screens in the conical screen units 24 and 28 are identical and it will be described in connection with the screen unit 24 as illustrated in FIG. 6. Screen unit 24 comprises an initial conical screen 50, an intermediate conical screen 52 and final conical screen 54. The conical screens have peripheral flange portions 56, 58 and 60 respectively. Screen 50 has a lower height to its apex than does the intermediate screen 52. Screen 52 has a lower height to its apex than does the conical screen 54. Accordingly, the conical screens may be stacked in an interfitting, nesting relationship with their respective flanges abutting. The individual screens are held together in a unit by the use of an end coupling 62 which is threadably received on the external thread of production tubing 18.

The conical screen unit 24 does not substantially reduce the effective flow diameter of producing tubing 18 but does present a large effective screen area to the combined gas and oil flow. The hole size of the screen is selected to produce a thorough mixing action for the gravity of oil being produced from the well without a substantial pressure loss. For low gravity oil, the holes would be relatively small and for high gravity oil the holes would be larger to minimize the pressure loss while retaining an effective mixing action. If desired, the holes sizes of the screen in the unit may be graduated with the largest hole size being selected for the initial conical screen 50 and with increasingly smaller hole sizes in the intermediate and final conical screens 52 and 54 respectively.

The conical screen units 28 incorporate identical screens 50, 52 and 54 to those incorporated in the conical screen unit 24. However, in the screen units 28, the unit is held between opposed sections of producing tubing 18 by a collar 64.

Figure 1:
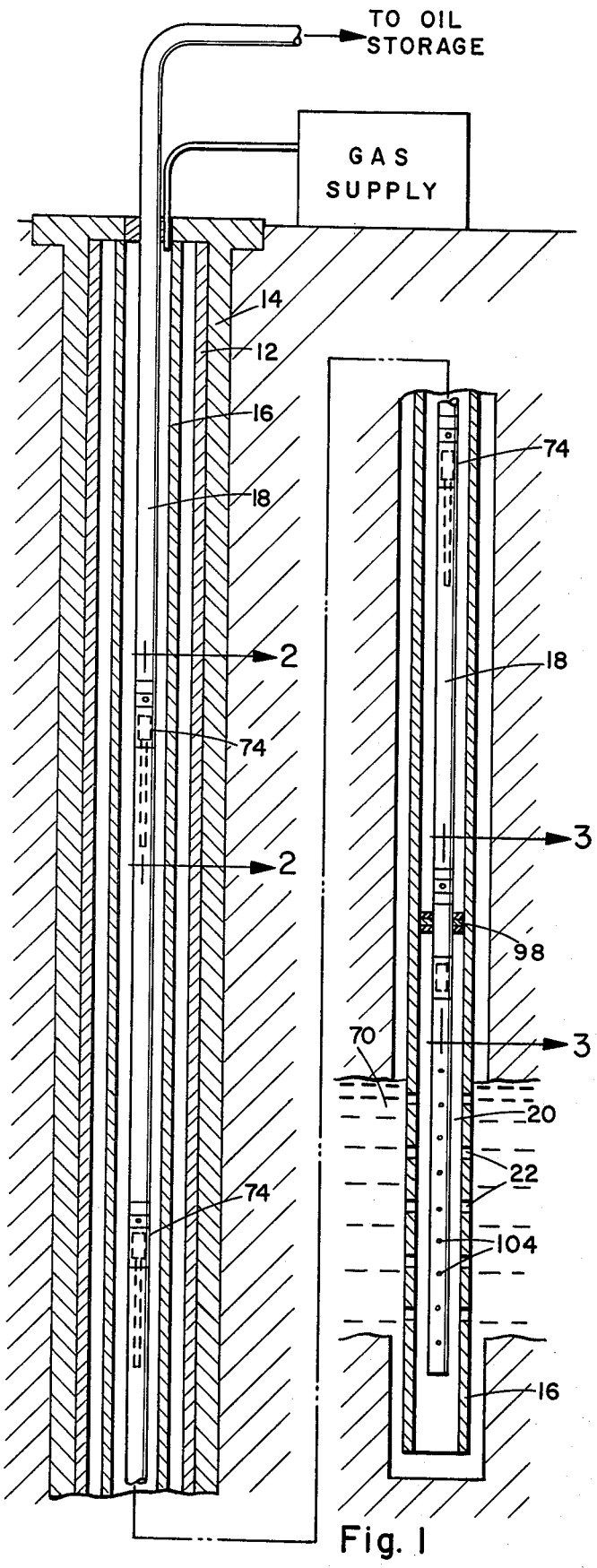
FIG. 1 is a vertical axial sectional view of a pipe string incorporating the novel features.

Referring now to FIG. 1, there is illustrated the use of the system according to the invention in a well requiring supplemental lift devices. The well is presumed to have insufficient pressure from the producing zone 70 to lift the gas from the well. It is also presumed that the well is excessively deep to use a single stage direct lift as in the FIG. 4 configuration because of the excessive pressure such single stage operations would produce. Accordingly, the system incorporates a plurality of supplemental lift devices 74. The lift devices 74 are placed within the producing tubing 18 at spaced vertical intervals.

Figure 2:
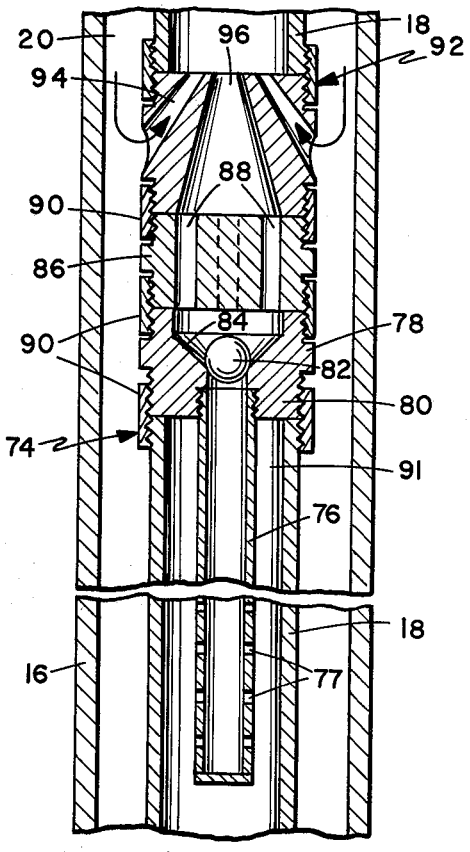
FIG. 2 is an enlarged sectional view taken on line 2—2 of FIG. 1.

FIG. 2 illustrates the nominal configuration for one such supplemental lift device 74. A central pipe 76 is positioned within the producing tubing 18 and is connected to the valve body of a check valve 78. A valve ball 82 may be seated against a valve seat 84 and is restrained against upward vertical movement out of the valve body 86 by manifold passages 88. The valve body 80 and manifold body 86 are held in assembled relation by couplings 90.

The central pipe 76 forms an annular plenum 91 with the production tubing 18. The plenum 91 receives gases which have separated from the oil/gas mixture passing up the production tubing. The oil/gas mixture passes into the central pipe 76 through the plurality of passages 77. After a sufficient quantity of gas accumulates in plenum 91, the gas is formed into remixture with the oil/gas mixture passing through the passages 77. Pressure from below forces the gas/oil mixture to move ball 82 off of the seat 84 and against the manifold body 86. kThe gas/oil mixture then flows through the plurality of manifold passages 88.

A jet pump 92 may be combined with the supplemental lift device 74. The jet pump 92 comprises a plurality of openings 94 which connect between the annulus and the interior of the producing tubing 18. Thus, gas pressure in the annulus is delivered by the openings 94 which form inwardly converging nozzles and produce an area of low pressure above the jet pump 92. The gas/oil mixture is drawn by the low pressure through the manifold passages 88 and into a converging conical section 96 of jet pump 92. The converging conical section 96 produces a high velocity stream of gas/oil mixture which is thoroughly mixed with the high velocity propellant gas passing through the nozzle passageways 94 to produce a re-energized gas/oil mixture that propels the gas/oil mixture to the next supplemental lift device.

Figure 3:
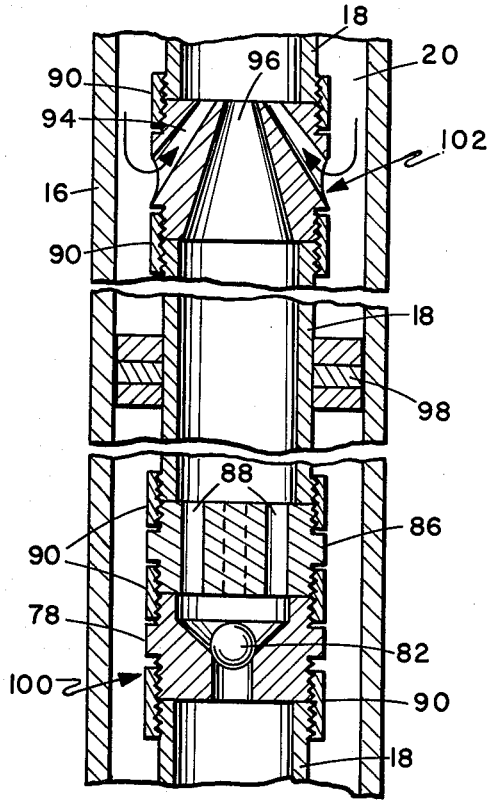
FIG. 3 is an enlarged sectional view taken on line 3—3 of FIG. 1.

FIG. 3 illustrates the tubing configuration at the end of the producing tubing 18 in the producing zone 70. A side wall packer 98 is utilized to seal between the producing tubing and production casing and prevents the gas pressure in annulus 20 from entering the strata. A check valve 100 has the same configuration as the check valve forming a part of the supplemental lift device 74. Check valve 100 prevents the initial pressurization of the well from driving oil back into the strata. Rather the initial pressurization of the well drive oil in annulus 20 through the jet pump 102 and up the producing tubing 18.

Jet pump 102 is identical to jet pump 92 illustrated in FIG. 2. After the initial oil is forced through the opening nozzles 94, the gas flowing through the nozzles 94 produces an area of low pressure. The low pressure lifts the ball 82 in check valve 100 off of its seat, and against the manifold body 86, thereby premitting oil to flow into the producing tubing 8 from the producing zone 70. A plurality of holes 104 are provided in the lower terminal portion of the producing tubing 18 to facilitate the admission of oil. The positioning of such holes is illustrated in the lower portion of FIG. 1.

Figure 7:
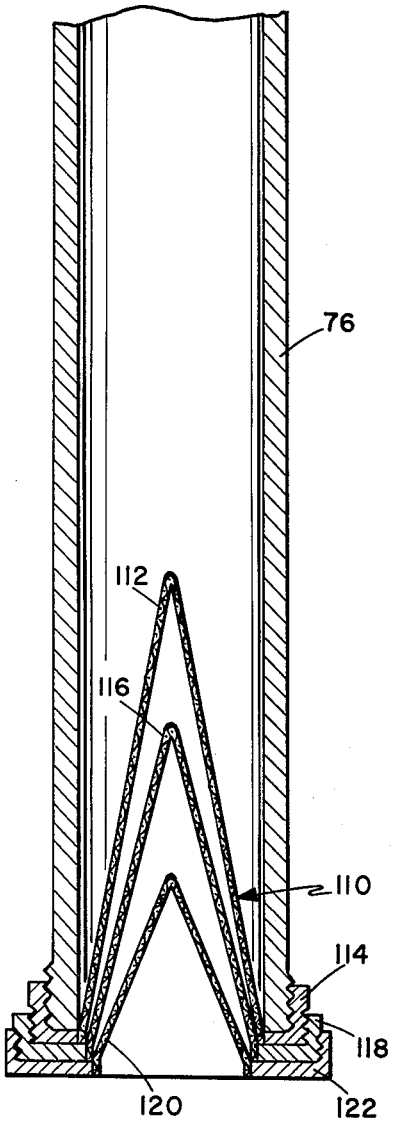
FIG. 7 is a sectional view showing an alternative configuration of FIG. 6.

Referring now to FIG. 7, there is illustrated a modified form of the mixing means for use where maximum oil/gas intermixture is necessary. The mixing means 110 is positioned at the lower terminal portion of the central pipe 76 of a supplemental lift device 74. In this configuration, the central pipe 76 does not have passages 77. The mixing means 110 is substituted for the passages and comprises conical screens comparable to the conical screens described in conjunction with FIGS. 4 through 6. The conical screens employed in he supplemental lift device are sized to fit within the inside diameter of the central pipe 76 and are provided with annular threaded collars. The final conical screen 112 has an annular collaar 114 which extends outwardly and upwardly from the terminal portion of the conical screen and has internal and external threads. The internal threads are sized to fit over the threads on the central pipe 76. The exterior threads accommodate the threads of the annular 118 on the interior conical screen 116. Annular member 118 is internally and externally and externally threaded. The external threads on the annular member 118 accommodate an annular member 122 on the initial conical screen 120. Thus the mixing means 110 provides a maximized screen area for promoting the mixing and for minimizing the separation of gas and oil in the central pipe 76 and provides a mixing means that may be easily removed for cleaning or replacement. When the producing tubing 18 is out of the well, the conical screens may be removed or replaced by merely unscrewing them from their relative interfitting relationship and screwing in a new or replacement screen member.

Figure 8:
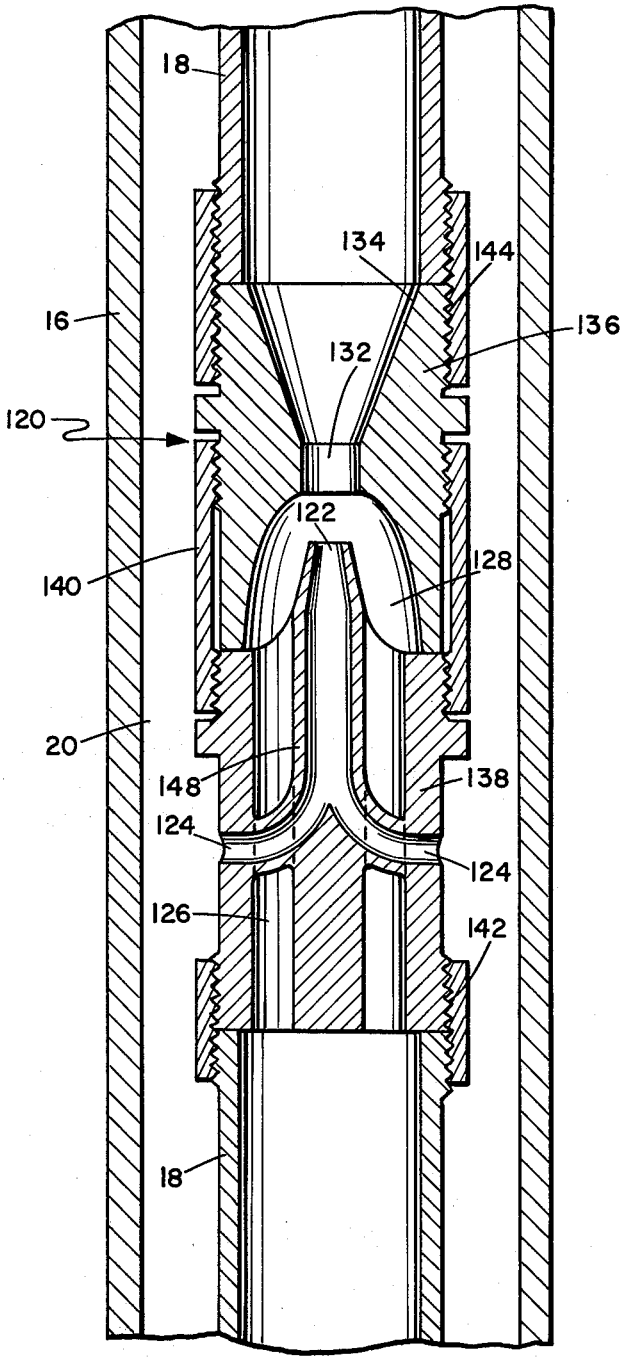
FIG. 8 is a sectional view of an alternative jet pump structure.

FIG. 8 illustrates a modification of the jet pump for use where maximum pumping effectiveness is required. The jet pump 120 incorporates a single central jet nozzle 122 which discharges pressurized gas into the gas/oil flow stream along the central axis of the jet pump 120. Supply gas for the central discharge is provided through a manifold of tubes 124. The tubes 124 connect between the exterior of the device in communication with the annulus 20, through the annular passageway 126 in the jet pump 120, and into the central nozzle member 124. The low pressure created by the gas jet from nozzle 122 draws the gas/oil mixture up through the annular passageway 126 and into the venturi plenum chamber 128. The gas and gas/oil mixture are intermixed at the maximum velocity flow section 132. A diffuser section 134 promotes the further mixing of the gas/oil mixture and provides a smooth transistion for discharge of the gas/oil mixture into the adjacent producing tubing section 18.

The design of the jet pump accommodates the venturi section in a venturi body member 136 and the jet section in a jet body member 138. The body portions are held together by joint connector 140. The jet body member 138 and venturi body member 136 terminate in external threads 142 and 144 respectively, so that the jet pump 120 may be connected between sections of producing tubing 18 by conventional connector members or may be connected directly to a supplemental lift device in the manner illustrated for the supplemental lift device 74 in FIG. 2.

Having described my invention, I now claim:

1. In a gas drive oil well pumping system utilizing gas under pressure to force oil from the well, including a cased well, a production tubing extending longitudinally through the well and cooperating with the casing thereof to define an annulus, means for introducing high pressure gas into the upper end of the annulus, a plurality of jet pump means disposed in longitudinally spaced relation in the tubing and each defining an elongate axially extending venturi, and means communicating with and between the venturi and the annulus to conduct gas from the annulus to said venturi to create suction in said tubing to lift gas and oil from the well in stages, the improvement comprising:

a plurality of check valve devices secured in the tubing in spaced apart relation along its length, whereby the gas/oil mixture is lifted in stages from the well, said check valve devices secured in the tubing closely adjacent and upstream of the jet pump means;

a central pipe secured inside the tubing immediately upstream and adjacent at least one of the check valve devices and communicating at one end with a check valve device for flow of gas and oil therethrough to the check valve device;

and gas/oil mixing devices comprising screen means having apertures therethrough sized to provide a total flow area approximately the flow area of the tubing, said screen means being secured on the other end of the central pipe, for maintaining the oil/gas intermixed and to thus enhance the lifting ability of the gas and thereby increase the efficiency of the system.

2. The gas drive oil well pumping system as in claim 1, wherein the mixing screen means each comprise at least one conical screen member having a flange on the base end thereof.

3. The gas drive oil well pumping system as in claim 2, wherein each mixing screen means comprises a plurality of nested together conical screens having different dimensions from the base to the apex thereof whereby the nested screens are in spaced apart relationship to one another and the flanges thereof are held together in contiguous relationship to one another.

4. The gas drive oil well pumping system as in claim 3, wherein the plurality of nested together screens include an inner screen, an intermediate screen, and an outer screen.

5. The gas drive oil well pumping system as in claim 4, wherein the flanges on the bases of said additional mixing screen means include threaded members, the threaded member of the inner screen being threadably engaged on the end of said central pipe, the threaded member of the intermediate screen being threadably engaged on the threaded member of the inner screen, and the threaded member of the outer screen being threadably engaged on the threaded member of the intermediate screen.

6. The gas drive oil well pumping system as in claim 1, wherein at least one of said jet pump means comprises a central gas discharge nozzle coaxially positioned relative to the production tubing.

7. The gas drive oil well pumping system as in claim 6, wherein a venturi is positioned immediately downstream from said central nozzle, and includes a diffuser section.

8. The gas drive oil well pumping system as in claim 1, wherein said check valve devices each comprise a valve body having a valve seat thereon, a valve ball for cooperation with the seat, and an apertured valve stop plate spaced from the valve seat to limit opening movement of the valve ball.

* * * * *